US008181562B2

(12) United States Patent
Goasduff et al.

(10) Patent No.: US 8,181,562 B2
(45) Date of Patent: May 22, 2012

(54) PRINCIPLE FOR THE INTEGRATION OF MISSILE-BASED WEAPON SYSTEMS ON A FIXED RAMP FOR STEALTH SURFACE VESSELS IN ORDER TO COUNTER ASYMMETRIC THREATS

(75) Inventors: Stéphane Goasduff, Queven (FR); Jean-Jacques Milin, Cleder (FR); Bruno Le Gall, Riantec (FR); Georges Pensec, Caudan (FR); Serge Philippe, Lorient (FR); Xavier Le Gourlay, Lanester (FR); Yvan Paulmery, Angouleme (FR)

(73) Assignee: DCNS, Paris (FR)

( * ) Notice: Subject to any disclaimer, the term of this patent is extended or adjusted under 35 U.S.C. 154(b) by 0 days.

(21) Appl. No.: 13/001,884

(22) PCT Filed: Jul. 1, 2009

(86) PCT No.: PCT/FR2009/051276

§ 371 (c)(1), (2), (4) Date: Apr. 4, 2011

(87) PCT Pub. No.: WO2010/001051

PCT Pub. Date: Jan. 7, 2010

(65) Prior Publication Data

US 2011/0167995 A1 Jul. 14, 2011

(30) Foreign Application Priority Data

Jul. 3, 2008 (FR) ..... 08 54521

(51) Int. Cl.
*B63G 1/00* (2006.01)

(52) U.S. Cl. ..... 89/1.819; 114/1

(58) Field of Classification Search ..... 89/1.819; 114/1, 5

See application file for complete search history.

(56) References Cited

U.S. PATENT DOCUMENTS 45,113 A * 11/1864 Albini ..... 114/1

(Continued)

FOREIGN PATENT DOCUMENTS

DE 00302006 A8 5/1989

(Continued)

OTHER PUBLICATIONS

International Search Report, dated Nov. 12, 2010, from corresponding PCT application.

*Primary Examiner* — Michelle Clement

(74) *Attorney, Agent, or Firm* — Young & Thompson

(57) ABSTRACT

Device for launching missiles from a ship, includes at least one missile launch ramp, includes a ditch delimited by side walls of which at least two constitute bulwarks which extend around the periphery of the ship, the ditch being open above the exterior deck of the ship, in that the launch ramp is positioned in the ditch so it can be used to launch a missile over a lateral bulwark of the ditch extending around the periphery of the ship. It includes an element for discharging the missile propulsion gases including a duct opening onto an orifice in a lateral bulwark of the ditch extending around the periphery of the ship, and the lateral bulwarks of the ditch are of a height tailored to conceal the missiles in place on the ramp, for angles of incidence of between 0 and −5° with respect to the deck of the ship.

20 Claims, 2 Drawing Sheets

U.S. PATENT DOCUMENTS

| | | | | |
|---|---|---|---|---|
| 282,498 | A * | 8/1883 | Clark | 114/1 |
| 1,486,114 | A * | 3/1924 | Akemann | 89/41.02 |
| 2,141,181 | A * | 12/1938 | Geddes | 114/259 |
| 4,173,919 | A * | 11/1979 | Piesik | 89/1.8 |
| 4,471,684 | A * | 9/1984 | Johnson et al. | 89/1.815 |
| 4,579,073 | A * | 4/1986 | Sadler et al. | 114/1 |
| 5,153,367 | A * | 10/1992 | Markquart et al. | 89/1.816 |
| 5,452,640 | A * | 9/1995 | Bovee et al. | 89/1.815 |
| 7,313,995 | B2 * | 1/2008 | Shah et al. | 89/1.815 |
| 7,849,782 | B2 * | 12/2010 | Heldmann | 89/46 |
| 7,854,189 | B1 * | 12/2010 | Fox | 89/1.804 |
| 2004/0069135 | A1 * | 4/2004 | Fowler | 89/1.805 |
| 2004/0200344 | A1 * | 10/2004 | Folgmann et al. | 89/1.814 |
| 2008/0156182 | A1 * | 7/2008 | Heldmann et al. | 89/1.804 |
| 2010/0024634 | A1 * | 2/2010 | McClellan et al. | 89/36.03 |
| 2010/0126338 | A1 * | 5/2010 | Rastegar et al. | 89/37.13 |
| 2010/0218668 | A1 * | 9/2010 | McClellan | 89/36.04 |
| 2010/0263526 | A1 * | 10/2010 | Heldmann | 89/37.01 |
| 2010/0282150 | A1 * | 11/2010 | Onuk | 114/15 |

FOREIGN PATENT DOCUMENTS

| | | | |
|---|---|---|---|
| EP | 0652153 | A1 | 5/1995 |
| FR | 2626242 | A1 | 7/1989 |

* cited by examiner

PRINCIPLE FOR THE INTEGRATION OF MISSILE-BASED WEAPON SYSTEMS ON A FIXED RAMP FOR STEALTH SURFACE VESSELS IN ORDER TO COUNTER ASYMMETRIC THREATS

The present invention relates to a device for launching a missile from a ship and to a ship equipped with such a device.

Military ships equipped with missile launch systems comprise missile launch devices consisting of integrated launch ramps so as to ensure that the missiles are launched over the sides of the ship, generally either in the port or starboard direction, at inclinations less than or equal to 45° with respect to the deck of the ship. These missiles, which are often contained in containers, are launched for example from fixed ramps arranged on the exterior deck of the ship. Such fixed ramps arranged on the deck have the disadvantage on the one hand of being visible and of having a large radar signature, and on the other hand of being vulnerable to asymmetric threats of the small-calibre artillery type or the like. In order to reduce the visual and radar signature of these missile ramps, bulwarks are sometimes arranged around these ramps, concealing them from such threats. Above a certain height, it is then necessary to provide orifices in these bulwarks in order to make it possible to discharge the missile propulsion gases. These orifices may be closed by covers which are designed to be ejected at the time of firing of the missiles under the effect of the gases released by the thrusters. It is also possible to close these orifices by doors in the side plating which can be opened at the time of firing of the missiles. In addition, it is also possible to provide deflectors arranged behind the missile launch ramps so as to orient the propulsion gases towards the openings provided in the bulwarks or over the bulwarks if the height of these bulwarks is limited. The solutions based on covers or doors in the side plating have the disadvantage of being expensive, complex to manufacture and difficult to use, particularly in the case of covers which necessarily have to be handled by operators in order to be replaced. In addition, during the firing of the missiles, the signature of the ship is modified until the door is closed again or until the covers are replaced. In order to avoid the need for covers, it is possible to provide exposed openings for discharging the gases. However, this arrangement has the disadvantage of not ensuring good protection against asymmetric threats and degrades the visual and radar signatures.

It has also been proposed to provide retractable missile ramps which have the advantage of being able to be concealed when not in use and thus of being well-protected against threats. This arrangement however, besides its significant cost, has the disadvantage of not ensuring the constant operational availability of the weapon system since it is necessary to put the missile ramps in position before being able to fire said missiles.

The aim of the present invention is to overcome these disadvantages by proposing a device for launching missiles from a ship which ensures a good protection of the missiles against asymmetric threats of the small-calibre artillery type or the like, which ensures a small radar and visual signature of the device so as to be compatible with the conditions imposed on a military stealth vessel, and which satisfies the functional constraints imposed by weapon systems consisting of missiles both under normal conditions of use and in the case of untimely ignition, this device meeting the operational requirements of constant availability of the weapon systems.

To this end, the invention relates to a device for launching missiles from a ship, of the type comprising at least one missile launch ramp. It comprises a ditch delimited by side walls, at least two of which extend around the periphery of the ship and constitute bulwarks, the ditch being open above the exterior deck of the ship. The launch ramp is arranged in the ditch in such a way that it can be used to launch a missile over a lateral bulwark of the ditch. The device comprises a means of discharging the missile propulsion gases comprising a duct opening onto an orifice provided in a lateral bulwark of the ditch, and the lateral bulwarks of the ditch have a height designed to conceal missiles arranged on the ramp, for an angle of incidence close to the horizontal of the ship.

Preferably, the height of the bulwarks of the ditch is designed to conceal missiles arranged on the ramp for an angle of incidence of between 0° and −5° with respect to the horizontal of the ship.

Preferably, the lateral bulwarks of the ditch, the gas discharge opening and the gas discharge duct are designed to minimize the visual and radar signatures of the device.

Preferably, the lateral bulwarks of the ditch are designed so as to be able to withstand at least attacks of the small-calibre artillery type.

Preferably, the gas discharge device comprises walls coated with refractory material.

Preferably, the missile launch ramp is fixed.

Preferably, the device is designed to launch a missile in a direction forming an angle of less than or equal to 45° with the deck of the ship.

The invention also relates to a ship of the type comprising a missile launch device on top of its exterior deck, the missile launch device being according to the invention.

Preferably, the missile launch device is designed for launching missiles laterally with respect to the ship.

The invention will now be described in a more precise and non-limiting manner with reference to the appended figures, in which.

Figure 1:
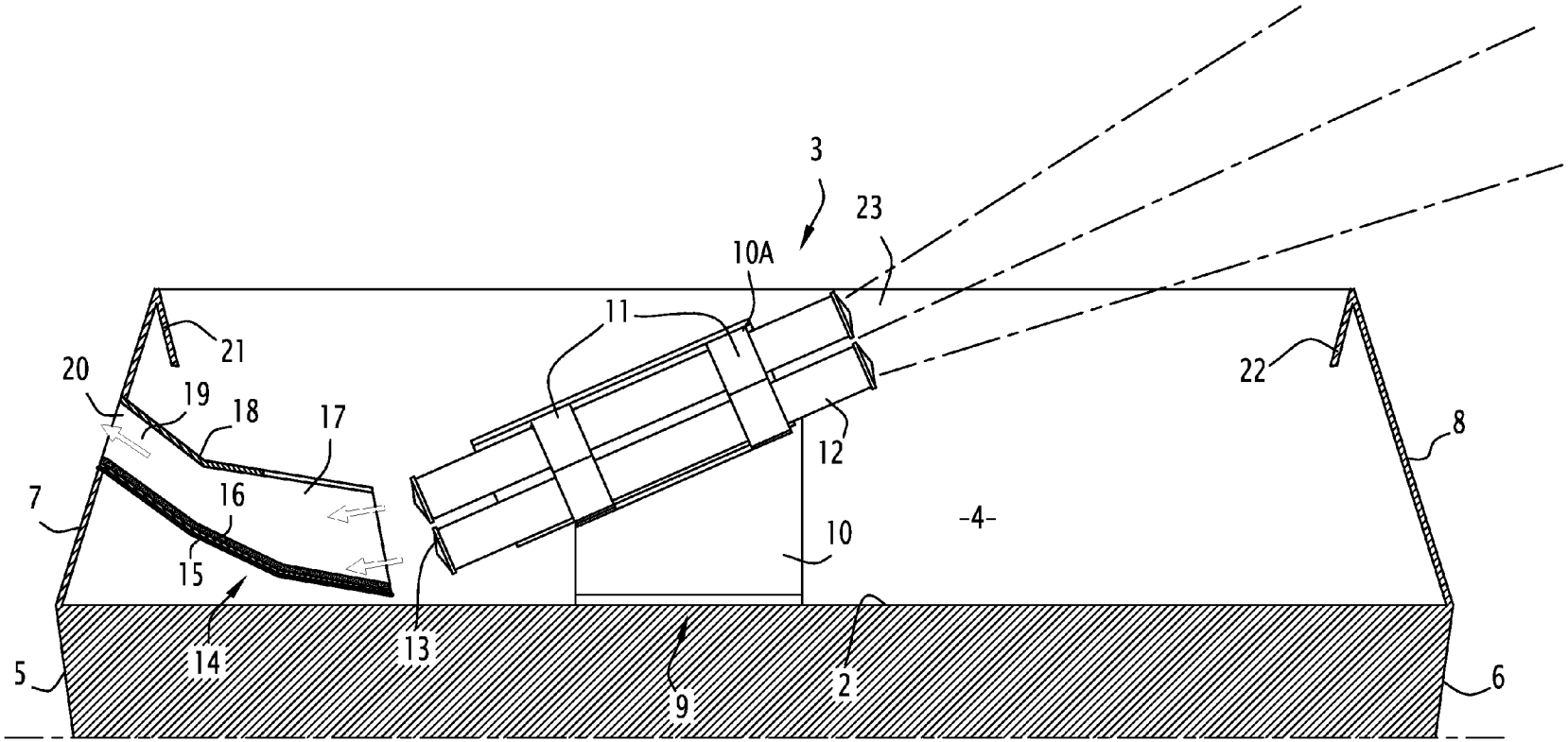
FIG. 1 is a schematic sectional view of a hull element of a ship equipped with a missile launch device.

FIG. 1 shows in section a hull 1 of a ship, the exterior deck 2 of which is equipped with a missile launch device denoted as a whole by 3. The missile launch device 3 consists of a missile launch ditch 4, the bottom of which is formed by the exterior deck 2 which extends over the entire width of the hull between the port side 5 and the starboard side 6 and which is delimited laterally by side walls 7 and 8 which constitute bulwarks. These bulwarks are made from armoured steel sheet so as to protect the missiles by withstanding at least attacks by low-power weapons such as light artillery. These bulwarks are slightly inclined inwards so as to minimize the radar signature for threats having an angle of incidence between the horizontal and −3°, preferably −5°, with respect to the horizontal. Horizontal is understood to mean the surface of the deck of the ship, which corresponds to the geographic horizontal when the ship is not listing.

A fixed missile launch ramp 9 is installed within the ditch 4. This missile launch ramp consists of a support 10, a sun protection cover 10A, holding cradles 11 and inclined missile containers 12.

The missile launch device comprises a means, denoted 14 as a whole, for discharging the missile propulsion gases during a nominal or restrained firing, that is to say resulting from the untimely ignition of the missile thrusters. This gas discharge means 14 is located opposite the rear end 13 of the missile containers. This gas discharge means comprises a deflector 15 consisting of metal sheets covered with a layer 16 of refractory material, said deflector being bounded by lateral flanges 17 and the upper part of which is partially covered by louvers 18 so as to constitute a duct 19 opening towards the outside by an opening 20 provided in the side wall 7. The geometry of the opening 20 and of the various walls of the duct 19 are designed so as on the one hand to ensure a good discharge of the gases either at the time of launching a missile or in the event of untimely ignition of a missile or even a plurality of missiles, and at the same time to ensure a small radar signature associated with the opening. The person skilled in the art knows how to determine the optimal geometries both to ensure a good discharge of gases and to ensure a small radar signature.

Furthermore, the bulwark 7 and the louvers 18 may be made from armoured steel or in a sufficient thickness so as to be able to ensure protection against attacks by moderate-power means, such as small-calibre artillery.

As indicated above, the side walls 7 and 8, that is to say the bulwarks, have heights designed to conceal the missile launch ramp equipped with its missiles from view and from observing radar systems which are located along the horizontal or slightly above the horizontal.

As indicated above, the gas discharge duct, defined by the deflector 15, the flanges 17 and the louvers 18, has a geometry designed to conceal the missile launch ramp equipped with its missiles from view and from observing radar systems which are located along the horizontal or slightly above the horizontal.

Moreover, in order to reduce the radar signature of the fixed missile launch ramp 9 particularly when the ship is inclined or if the threats have an angle of incidence between the horizontal and −3°, preferably −5°, with respect to the horizontal, the bulwarks 7 and 8 comprise inner flaps 21 and 22 (turned-over edge) which are inclined with angles designed to ensure that the radar waves are reflected in directions that are different to the arrival direction.

Of course, the height of the bulwarks and also the position of the launch ramps and the inclination of the missile containers on these launch ramps are designed so that the missile release cone 23 passes over the upper crest of the bulwarks. As can be seen in this figure, this arrangement presumes that the ship is wide enough to be able to hold all the equipment while ensuring both good operation and good protection against asymmetric attacks, good optical dissimulation and a small radar signature.

For some missiles for which the thermal effects of the propulsion gases are significant and/or for which there is a risk of untimely firing, the consequences of which on the platform with regard to the likelihood of occurrence are deemed inacceptable, the gas discharge duct defined by the deflector 15, the flanges 17 and the louvers 18 is partially coated with refractory materials. The placement of these coatings makes it possible to ensure the safety of the platform and of the personnel by guaranteeing the integrity of the device during and after firing. Reuse of the device always remains possible.

In general, such missile launch devices are mounted on ships such as frigates which are wide enough to be able to install two missile ramps, one oriented so as to be able to send missiles over the port side and the other oriented so as to be able to send missiles over the starboard side.

Figure 2:
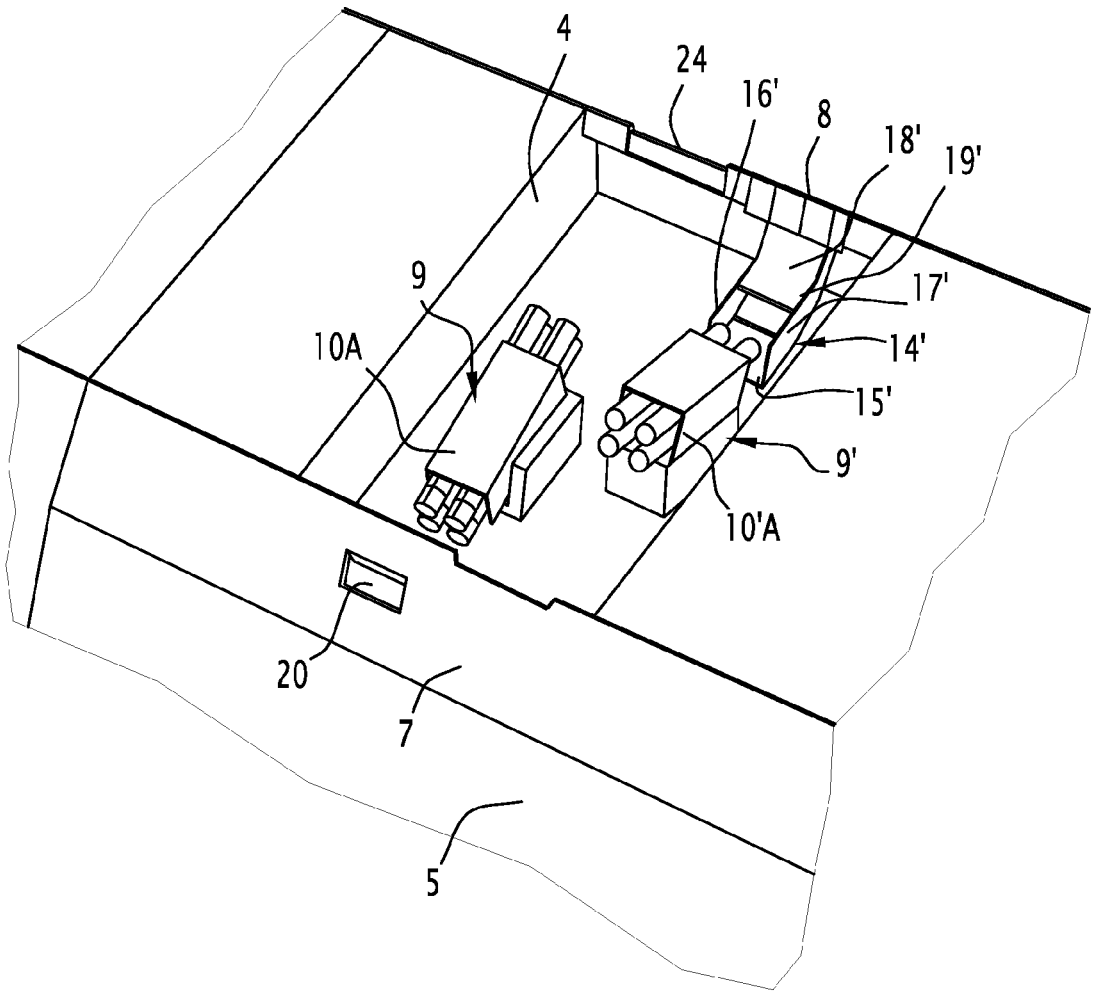
FIG. 2 is a perspective view, from above, of a missile launch device arranged on the upper deck of a ship.

An installation of this type is shown in FIG. 2, in which the missile launch ditch 4 is equipped with two missile launch ramps 9 and 9'.

The launch ramp 9 is supplemented by a gas discharge means (not visible in the figure) which opens into an opening 20 provided in the bulwark 7 extending along the port side 5 of the ship. This launch ramp is provided for launching missiles over the bulwark 8 extending along the starboard side 6. The bulwark 8 comprises a cut-out 24 which makes it possible to respect the missile release cone while retaining a margin making it possible to overcome any positioning or manufacturing defect. The missile launch ditch 4 comprises a second missile launch ramp 9' oriented so as to be able to launch missiles over the bulwark 7 located on the port side. This missile launch ramp 9' is arranged in front of a gas discharge means 14' consisting of a deflector 15' which is bounded by lateral flanges 17' and the upper part of which is covered by louvers 18 so as to form a gas discharge duct 19'.

The missile launch device that has just been described and which can equip ships such as frigates is able to launch missiles either to the port or starboard side of the ship.

However, it is possible to arrange such missile launch devices in the front or rear part of the ship with launch ramps oriented so as to be able to launch missiles towards the front or towards the rear of the ship.

In any case, the ditch of the missile launch device is delimited by side walls which extend around the periphery of the ship. Walls which extend around the periphery of the ship are intended to mean walls which extend at least partially along the port or starboard sides or along the rear of the ship.

The invention claimed is:

1. Device for launching missiles from a ship, of the type comprising at least one missile launch ramp (9, 9'), characterized in that it comprises a ditch (4) delimited by side walls, at least two (7, 8) of which constitute bulwarks which extend around the periphery of the ship, the ditch being open above the exterior deck of the ship, in that the launch ramp (9, 9') is arranged in the ditch in such a way that it can be used to launch a missile over a lateral bulwark (7, 8) of the ditch extending around the periphery of the ship, in that it comprises a means (14, 14') of discharging the missile propulsion gases comprising a duct (19, 19') opening onto an orifice (20) provided in a lateral bulwark (7) of the ditch extending around the periphery of the ship, and in that the lateral bulwarks (7, 8) of the ditch have a height designed to conceal missiles arranged on the ramp, for an angle of incidence close to the horizontal of the ship.

2. Device according to claim 1, characterized in that the height of the bulwarks (7, 8) of the ditch is designed to conceal missiles arranged on the ramp (9, 9') for an angle of incidence of between 0° and −5° with respect to the deck of the ship.

3. Device according to claim 2, characterized in that the lateral bulwarks (7, 8) of the ditch, the gas discharge opening (20) and the gas discharge duct (19) are designed to minimize the visual and radar signatures of the device.

4. Device according to claim 2, characterized in that the lateral bulwarks (7, 8) of the ditch are designed so as to be able to withstand at least attacks of the small-calibre artillery type.

5. Device according to claim 2, characterized in that the gas discharge device (14, 14') comprises walls (15, 15') coated with refractory material.

6. Device according to claim 2, characterized in that the missile launch ramp (9, 9') is fixed.

7. Device according to claim 2, characterized in that the device is designed to launch a missile in a direction forming an angle of less than or equal to 45° with the deck of the ship.

8. Device according to claim 1, characterized in that the lateral bulwarks (7, 8) of the ditch, the gas discharge opening (20) and the gas discharge duct (19) are designed to minimize the visual and radar signatures of the device.

9. Device according to claim 8, characterized in that the lateral bulwarks (7, 8) of the ditch are designed so as to be able to withstand at least attacks of the small-calibre artillery type.

10. Device according to claim 8, characterized in that the gas discharge device (14, 14') comprises walls (15, 15') coated with refractory material.

11. Device according to claim 8, characterized in that the missile launch ramp (9, 9') is fixed.

12. Device according to claim 1, characterized in that the lateral bulwarks (7, 8) of the ditch are designed so as to be able to withstand at least attacks of the small-calibre artillery type.

13. Device according to claim 12, characterized in that the gas discharge device (14, 14') comprises walls (15, 15') coated with refractory material.

14. Device according to claim 12, characterized in that the missile launch ramp (9, 9') is fixed.

15. Device according to claim 1, characterized in that the gas discharge device (14, 14') comprises walls (15, 15') coated with refractory material.

16. Device according to claim 15, characterized in that the missile launch ramp (9, 9') is fixed.

17. Device according to claim 1, characterized in that the missile launch ramp (9, 9') is fixed.

18. Device according to claim 1, characterized in that the device is designed to launch a missile in a direction forming an angle of less than or equal to 45° with the deck of the ship.

19. Ship of the type comprising a missile launch device on top of its exterior deck, characterized in that the missile launch device is according to claim 1.

20. Ship according to claim 19, characterized in that the missile launch device is designed for launching missiles laterally with respect to the ship.

* * * * *